US007976905B2

(12) United States Patent
McNeil et al.

(10) Patent No.: US 7,976,905 B2
(45) Date of Patent: Jul. 12, 2011

(54) METHOD FOR THE TRANSFER OF A FLUID TO A MOVING WEB MATERIAL

(75) Inventors: Kevin Benson McNeil, Loveland, OH (US); Kim Ellen Shore, Goshen Township, OH (US); Wayne Robert Fisher, Cincinnati, OH (US); Richard Matthew Giachetto, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 12/552,561

(22) Filed: Sep. 2, 2009

(65) Prior Publication Data

US 2010/0043884 A1 Feb. 25, 2010

Related U.S. Application Data

(62) Division of application No. 11/067,437, filed on Feb. 25, 2005, now Pat. No. 7,611,582.

(51) Int. Cl.
*B05D 1/28* (2006.01)

(52) U.S. Cl. ..... 427/428.12; 427/256; 427/428.07; 427/429

(58) Field of Classification Search ..... 427/428.12, 427/256, 429

See application file for complete search history.

(56) References Cited

U.S. PATENT DOCUMENTS

| | | | | |
|---|---|---|---|---|
| 3,148,401 | A * | 9/1964 | Ralph et al. | 401/156 |
| 4,770,909 | A | 9/1988 | McIntyre | |
| 5,022,948 | A | 6/1991 | Hallworth | |
| 5,332,472 | A | 7/1994 | Cutright et al. | |
| 5,520,958 | A | 5/1996 | Doesburg et al. | |
| 6,647,883 | B1 | 11/2003 | McNeil | |
| 2003/0175441 | A1 | 9/2003 | Bernards | |

FOREIGN PATENT DOCUMENTS

| | | |
|---|---|---|
| EP | 0 347 206 | 12/1989 |
| GB | 1 376 298 | * 12/1974 |
| JP | 63 274544 | 2/1989 |

* cited by examiner

*Primary Examiner* — Frederick J Parker
(74) *Attorney, Agent, or Firm* — Peter D. Meyer

(57) ABSTRACT

The present disclosure provides for a method for transferring fluid. The method provides for the steps of: a) providing a fluid transfer component comprising a first surface, a second surface, a non-random pattern of distinct pores, the pores connecting the first surface and the second surface, the pores being disposed at preselected locations to provide a desired pattern of permeability, b) providing a fluid receiving component comprising a fluid receiving surface, c) motivating a fluid into contact with the first surface and subsequently through the distinct pores to the second surface, d) bringing the second surface and the fluid receiving surface into fluid transfer proximity, e) transferring fluid from the second surface to the fluid receiving surface.

9 Claims, 2 Drawing Sheets

METHOD FOR THE TRANSFER OF A FLUID TO A MOVING WEB MATERIAL

This application is a divisional of, and claims priority to, prior application Ser. No. 11/067,437 filed on Feb. 25, 2005, now U.S. Pat. No. 7,611,582.

FIELD OF THE INVENTION

This invention relates to methods for the transfer of fluids to a surface. The invention relates particularly to methods for the transfer of fluids to a web surface. The invention relates more particularly to the transfer of fluids to the surface of a moving web material.

BACKGROUND OF THE INVENTION

The transfer of fluids to a moving web surface is well known in the art. The selective transfer of fluids for purposes such as printing is also well known. The selective transfer of a fluid to a surface by way of a permeable element is well known. Screen printing is a well known example of the transfer of a fluid to a surface through a permeable element. The design transferred in screen printing is formed by selectively occluding openings in the screen that are located according to the formation of the screen. The aspect ratio of the holes and fluid viscosity may limit the fluid types, application rate, or fluid dose that may be applied with screen printing.

Gravure printing is also a well known method of transferring fluid to the surface of a moving web material. The use of fixed volume cells engraved onto a print cylinder ensures high quality and consistency of fluid transfer over long run times. However, a given cylinder is limited in the range of flowrates possible per unit area of web surface.

Previous fluid application efforts have also utilized sintered metal surfaces as transfer elements. A pattern of permeability has been formed using the pores in the element. These pores may be generally closed by plating the material and then selectively reopened by machining a desired pattern upon the material and subsequently chemically etching the machined portions of the element to reveal the existing pores. In this manner a pattern of permeability corresponding to the pores initially formed in the material may be formed and used to selectively transfer fluid. The nature of the pores in a sintered material is generally such that the tortuosity of the pores predisposes the pores to clogging by fluid impurities.

The placement of the fluid is limited in the prior art to the pores or openings present in the material that may be selectively closed or generally closed and selectively reopened. The present invention provides an ability to form a pattern of permeability by forming pores at selected locations. The location of the fluid transfer points may be decoupled from the inherent structure of the transfer medium.

The present invention also provides for a broad range of fluid flow per unit area of the web surface by manipulating the motive force on the fluid across the fluid transfer points.

SUMMARY OF THE INVENTION

The present disclosure provides for a method for transferring fluid. The method comprises steps of: a) providing a fluid transfer component comprising a first surface, a second surface, a non-random pattern of distinct pores, the pores connecting the first surface and the second surface, the pores disposed at preselected locations to provide a desired pattern of permeability, b) providing a fluid receiving component comprising a fluid receiving surface, c) motivating a fluid into contact with the first surface and subsequently through the distinct pores to the second surface, d) bringing the second surface and the fluid receiving surface into fluid transfer proximity, and e) transferring fluid from the second surface to the fluid receiving surface.

DETAILED DESCRIPTION OF THE INVENTION

The apparatus of the invention will be described in terms of an apparatus for applying a fluid to a moving web material. Those of skill in the art will appreciate that the invention is not limited to this embodiment.

Figure 1:
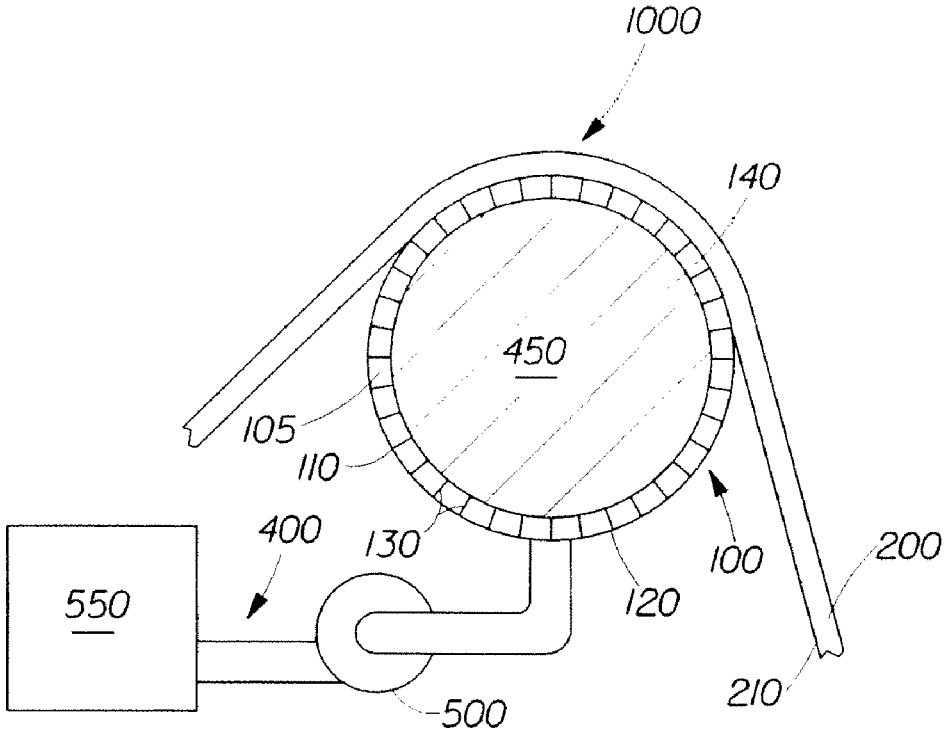
FIG. 1 schematically illustrates a side view of an apparatus according to one embodiment of the invention.

According to FIG. 1 the apparatus 1000 comprises a fluid transfer component 100. The fluid transfer component 100 comprises a first surface 110 and a second surface 120. The fluid transfer component further comprises pores 130 connecting the first surface 110 and the second surface 120. The pores 130 are disposed upon the fluid transfer component 100 in a non-random preselected pattern. A fluid supply 400 is operably connected to the fluid transfer component 100 such that a fluid 450 may contact the first surface 110 of the fluid transfer component 100. The apparatus 1000 further comprises a fluid motivating component 500. The fluid motivating component 500 provides an impetus for the fluid 450 to move from the first surface 110 to the second surface 120 via the pores 130. The apparatus further comprises a fluid receiving component comprising a web 200. The web 200 comprises a fluid receiving surface 210. The fluid receiving surface may contact droplets of fluid 450 formed upon the second surface 120. Fluid 450 may pass through pores 130 from the first surface 110 to the second surface 120 and may transfer to the fluid receiving surface 210.

FIG. 1 illustrates a cylindrical fluid transfer component 100. The cylindrical fluid transfer component 100 may comprise a hollow cylindrical shell 105. The cylindrical shell 105 may be sufficiently structural to function without additional internal bracing. The cylindrical shell 105 may comprise a thin outer shell and structural internal bracing to support the cylindrical shell 105. The cylindrical shell 105 may comprise a single layer of material or may comprise a laminate. The laminate may comprise layers of a similar material or may comprise layers dissimilar in material and structure. In one embodiment the cylindrical shell 105 comprises a stainless steel shell having a wall thickness of about 0.125 inches (3 mm). In another embodiment (not shown) the fluid transfer component 100 may comprise a flat plate. In another embodiment (not shown) the fluid transfer component 100 may comprise a regular or irregular polygonal prism.

The fluid application width of the apparatus may be adjusted by providing a single fluid transfer component 100 of appropriate width. Multiple individual fluid application components 100 may be combined in a series to achieve the desired width. As a non-limiting example, a plurality of stainless steel cylinders each having a shell thickness of about 0.125 inches (3 mm) and a width of about 6 inches (about 15 cm) may be coupled end to end with an appropriate seal— such as an o-ring seal between each pair of cylinders. In this example the number of shells combined may be increased until the desired application width is achieved.

The fluid transfer component 100 further comprises pores 130 connecting the first surface 110 and the second surface 120. Connecting the surfaces refers to the pores 130 each providing a pathway for the transport of a fluid 450 from the first surface 110 to the second surface 120. In one embodiment the pores 130 may be formed by the use of electron beam drilling as is known in the art. Electron beam drilling comprises a process whereby high energy electrons impinge upon a surface resulting in the formation of holes through the material. In another embodiment the pores may be formed using a laser. In another embodiment the pores may be formed by using a drill bit. In yet another embodiment the pores 130 may be formed using electrical discharge machining as is known in the art.

In one embodiment the pores 130 comprise holes that are substantially straight and normal to the outer surface of the fluid transfer component 100. In another embodiment the pores 130 comprise holes proceeding at an angle other than 90 degrees from the outer surface 120 of the fluid transfer component 100. In each of these embodiments each of the pores 130 comprise a single passageway having a single entry point at the first surface 110 and a single exit point at the second surface 120.

In one embodiment the pores 130 may be provided by electron beam drilling and may have an aspect ratio of 25:1. The aspect ratio represents the ratio of the length of the pore 130 to the diameter of the pore 130. Therefore a pore having an aspect ratio of 25:1 has a length 25 times the diameter of the pore 130. In this embodiment the pores 130 may have a diameter of between about 0.001 inches (0.025 mm) and about 0.030 inches (0.75 mm). The pores 130 may be provided at an angle of between about 20 and about 90 degrees from the second surface 120 of the fluid transfer component 100. The pores 130 may be accurately positioned upon the second surface 120 of the fluid transfer component 100 to within 0.0005 inches (0.013 mm) of the desired non-random pattern of permeability.

In one embodiment the 25:1 aspect ratio limit may be overcome to provide an aspect ratio of about 60:1. In this embodiment holes 0.005 inches (0.13 mm) in diameter may be electron beam drilled in a metal shell about 0.125 inches (3 mm) in thickness. Metal plating may subsequently be applied to the surface of the shell. The plating may reduce the nominal pore 130 diameter from about 0.005 inches (0.13 mm) to about 0.002 inches (0.05 mm).

The opening of the pore 130 at the second surface 120 may comprise a simple circular opening having a diameter similar to that of the portion of the pore 130 extending between the first surface 110 and the second surface 120. In one embodiment the opening of the pore 130 at the second surface 120 may comprise a flaring of the diameter of the portion of the pore 130 extending between the surfaces 110, 120. In another embodiment, the opening of the pore 130 at the second surface 120 may reside in a recessed portion 125 of the second surface 120. The recessed portion 125 of the second surface 120 may be recessed from the general surface by about 0.001 to about 0.030 inches (about 0.025 to about 0.72 mm). In one embodiment the second surface 120 may comprise at least one groove 135 extending from one pore 130. The groove 135 may comprise a v, u, or otherwise shaped cross section. The groove 135 may be from about 0.001 to about 0.050 inches (about 0.025 to about 1.27 mm) in width and in depth. The groove 135 may extend from a first pore 130 to a second pore 130 or may extend from a first pore 130 and terminate. A plurality of grooves 135 may be present upon the second surface 120. The plurality of grooves 135 may extend from a single pore 130 or from a plurality of pores. The grooves 135 may connect to a single pore 130 or may connect multiple pores 130.

The accuracy with which the pores 130 may be dispositioned upon the second surface 120 of the fluid transfer component 100 enables the permeable nature of the fluid transfer component 100 to be decoupled from the inherent porosity of the fluid transfer component 100. The permeability of the fluid transfer component 100 may be selected to provide a particular benefit via a particular fluid application pattern. Locations for the pores 130 may be determined to provide a particular array of permeability in the fluid transfer component 100. This array may permit the selective transfer of fluid 450 droplets formed at pores 130 to a fluid receiving surface 210 of a moving web 200 brought into contact with fluid 450 droplets.

In one embodiment the array of pores 130 may be disposed to provide a uniform distribution of fluid 450 droplets to maximize the ratio of fluid 450 surface area to applied fluid 450 volume. In one embodiment this may be used to apply an adhesive in a pattern of dots to maximize the potential for adhesion between two surfaces for any volume of applied adhesive. As an example, in the production of paper toweling and bath tissue, the paper substrate is adhesively attached to a wound cardboard core and subsequently wound about the core. The application of a selective array of adhesive dots to the core may maximize the surface area of adhesive available from a given amount of adhesive.

Figure 2:
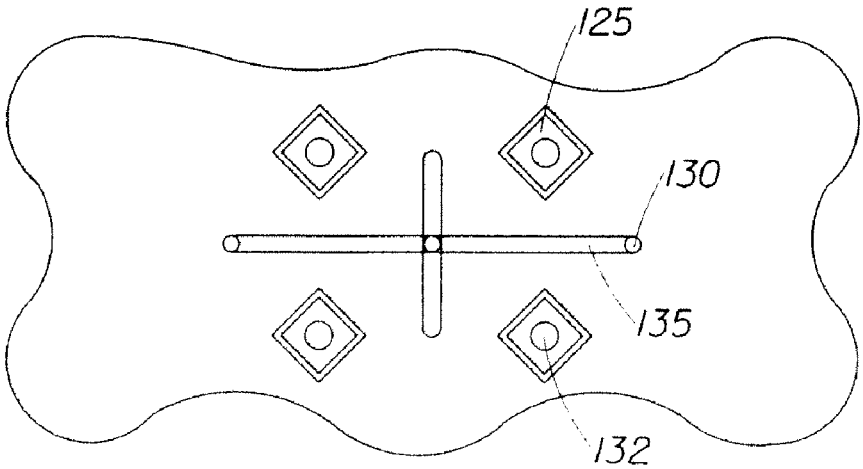
FIG. 2 schematically illustrates a portion of a fluid transfer component according to one embodiment of the invention.

The pattern of pores 130 upon the second surface 120 may comprise an array of pores 130 having a substantially similar diameter or may comprise a pattern of pores 130 having distinctly different pore diameters. In one embodiment illustrated in FIG. 2 the array of pores 130 comprises a first set of pores 130 having a first diameter and arranged in a first pattern. The array further comprises a second set of pores 132 having a second diameter and arranged in a second pattern. The first and second patterns may be arranged to interact each with the other. The multiple patterns may visually complement each other. The multiple patterns of pores may be arranged such that the applied fluid patterns interact functionally.

The patterns of pores 130 may be used to impart visually significant features to the web material 200. The array of pores 130 may be used to apply one or more pigmented fluids to the web 200. The pigmented fluids may be used in association with other features of the web 200. As an example, in one embodiment the pores 130 of the fluid transfer component 100 may be used to apply an ink to a web 200.

The pattern of pores 130 may be disposed such that the ink is applied corresponding to embossed or otherwise applied features of the web 200. The pattern of pores 130 may be arrayed such that the applied fluid presents a visual image upon the fluid receiving component 200. Multiple fluid transfer components 100 may be utilized to successively apply a plurality of inks of varying colors to a single web 200 to compose a multi-color image. One or more inks may be applied to the web 200 in conjunction with any indicia applied to the web 200 by other means known in the art. A conventionally printed image may be complemented by the addition of a pattern of fluid 450 applied by the apparatus 1000 of the invention.

The application of fluid 450 from the pattern of the pores 130 to the web 200 may be registered. By registered it is meant that fluid 450 applied from particular pores 130 of the pattern deliberately corresponds spatially with particular portions of the web 200. This registration may be accomplished by any registration means known to those of skill in the art. In one embodiment the registration of the pores 130 and the web 200 may be achieved by the use of a sensor adapted to identify a feature of the web 200 and by the use of a rotary encoder coupled to a rotating fluid transfer component 130. The rotary encoder may provide an indication of the relative rotary position of at least a portion of the pattern of pores 130. The sensor may provide an indication of the presence of a particular feature of the web 200. Exemplary sensors may detect features imparted to the web 200 solely for the purpose of registration or the sensor may detect regular features of the web 200 applied for other reasons. As an example, the sensor may optically detect any indicia printed or otherwise imparted to the web 200. In another example the sensor may to detect a localized physical change in the web 200 such as a slit or notch cut in the web 200 for the purpose of registration or as a step in the production of a web based product. The registration may further incorporate an input from a web speed sensor.

By combining the data from the rotary encoder, the feature sensor, and the speed sensor, a controller may determine the position of a web feature and may relate that position to the position of a particular pore 130 or set of pores 130. By making this relation the system may then adjust the speed of either the rotating fluid transfer component 100 or the speed of the web 200 to adjust the relative position of the pore 130 and web feature such that the pore 130 will interact with the web 200 with the desired spatial relationship between the feature and the applied fluid 450.

Such a registration process may permit multiple fluids 450 to be applied in registration each with the others. Other possibilities include registering fluids 450 with embossed features, perforations, apertures, and indicia present due to papermaking processes.

The web 200 may comprise any web material known to those of skill in the art. Exemplary web materials include, without being limiting, paper webs such as bath tissue and paper toweling, chipboard, newsprint, and heavier grades of paper, polymeric films, non-woven webs, metal foils, and woven fabric materials. The web 200 may comprise an endless or seamed belt that comprises a portion of a manufacturing or material handling apparatus. The web 200 may comprise an embryonic belt as a step in a manufacturing process for producing belts. The fluid receiving surface 210 of the web 200 may contact fluid 450 droplets formed at the pores 130 or extended droplets formed at the pores 130 and along grooves 135 or residing in recessed areas 125.

In one embodiment the apparatus 1000 may be configured such that the web 200 wraps at least a portion of the circumference of a cylindrical fluid transfer component 100. In this embodiment the extent of the wrap by the web 200 may be fixed or variable. The degree of wrap may be selected depending upon the amount of contact time desired between the web 200 and the fluid transfer component 100. The range of the degree of wrap may be limited by the geometry of the processing equipment. Web 200 wraps as low as 5 degrees and in excess of 300 degrees are possible. For a fixed wrap the apparatus 1000 may be configured such that the web 200 consistently contacts a fixed portion of the circumference of the fluid transfer component 100. In a variable wrap embodiment (not shown) the extent of the fluid transfer component 100 contacted by the web 200 may be varied by moving a web contacting dancer arm to bring more or less of the web 200 into contact with the fluid transfer component 100.

In another embodiment the apparatus 1000 may be configured such that the web 200 contacts a flat surface 115 of the fluid transfer component 100. In this embodiment the apparatus 1000 may be configured such that the fluid transfer component 100 moves from a first position in contact with the web 200 to a second position out of contact with the web 200. In one embodiment the web 200 may be moved as or after the fluid transfer component 100 ceases contact with the web 200. In this embodiment the apparatus 1000 comprises a transfer enabling component 600. The transfer enabling component 600 enables the transfer of the fluid 450 from the fluid transfer component 100 to the fluid receiving component 200.

In one embodiment the transfer enabling component 600 may enable this transfer by moving the fluid transfer component 100 into fluid transfer proximity with the web 200. In another embodiment the transfer enabling component 600 may enable the transfer of the fluid 450 by moving the web 200 into fluid transfer proximity with the fluid transfer component 100. In another embodiment the transfer enabling component 600 may enable this fluid 450 transfer by moving each of the fluid transfer component 100 and the web 200 until the two components are within fluid transfer proximity of each other. Fluid transfer proximity refers to a spatial relationship between the web 200 and the fluid transfer component 100 such that fluid 450 droplets formed on the second surface 120 contact the receiving surface 210 and enable transfer from the second surface 120 to the receiving surface 210.

In another embodiment the web 200 may move in relation to the second surface 120 while in contact with the fluid 450 droplets formed upon the second surface 120. In this embodiment the fluid 450 transferred to the web 200 may be smeared due to the relative motion of the web 200 and the fluid transfer component 100 during the transfer of the fluid 450.

Figure 3:
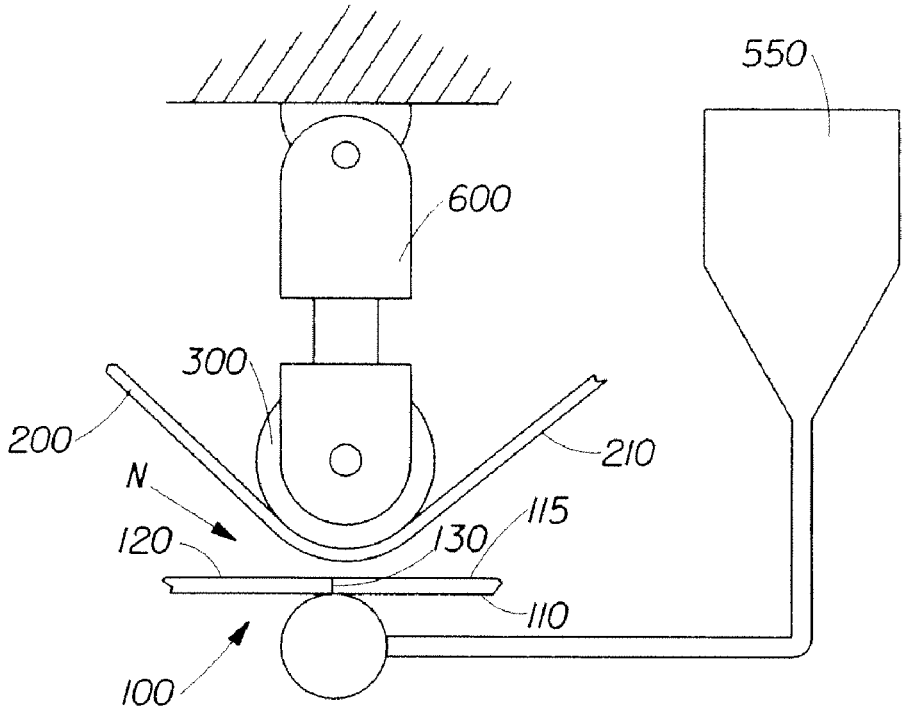
FIG. 3 schematically illustrates a side view of an apparatus according to another embodiment of the invention; and, FIG. 4 schematically illustrates a portion of an internal roller according to one embodiment of the invention.

The embodiment illustrated in FIG. 3 further comprises a support component 300 adapted to support the web 200 as the web 200 contacts the fluid 450 droplets formed upon the fluid transfer component 100. The support component 300 may be configured as a moving belt or conveying chain, as a roller or set of rollers forming a nip N with the fluid transfer component 100, or as a fixed surface forming a nip N with the fluid transfer component 100.

In one embodiment the position of the support component 300 relative to the fluid transfer component 100 may be adjustable via the transfer enabling component 600 described above. In another embodiment the relative position of the fluid transfer component and the support component 300 may be substantially fixed.

In one embodiment the support component 300 comprises a rotatable cylinder having an axis of rotation parallel to the fluid transfer component 100. The direction of rotation of the rotatable cylinder 300 is in the direction of travel of the web 200. In this embodiment the web 200 passes through a nip N formed between the two components 100, 300. The nip N may be an open nip or a closed nip. An open nip is defined as a gap between the components 100, 300. An open nip N may be a compressive or non-compressive nip N. A compressive nip N provides less of a space between the two components than the thickness of the web 200. As an example, a nip gap of 0.005 inches (about 0.127 mm) for the passage of a web of 0.007 inches (0.178 mm) is a compressive nip N. A configuration wherein the two components 100, 300 contact each other along the path of the web 200 is considered a closed nip N. The web 200 necessarily contacts the second surface 120 in a closed or compressive nip N. A non-compressive nip N provides a nip gap equal to or greater than the thickness of the web 200. The web 200 need not necessarily contact the second surface 120 in a non-compressive nip N. In one embodiment the rate of fluid 450 transfer to the web 200 may be increased by increasing the degree of compression of the nip N. Similarly, the rate of fluid 450 transfer may be decreased by decreasing the nip pressure, or degree of compression.

The apparatus 1000 further comprises a fluid supply 400. The fluid supply 400 may comprise any fluid holding means compatible with the particular fluid 450 being transferred that is known in the art. In one embodiment the fluid supply 400 comprises a fluid inlet adapted to attach to a container of fluid 450 as provided by a fluid supplier. Providing additional fluid 450 in this embodiment comprises replacing a first fluid container with another fluid container. In another embodiment the fluid supply 400 comprises a reservoir tank 550 that fluid 450 may be added to as needed. Optionally the fluid supply 400 may comprise fluid heating and cooling means as are known in the art. Other optional components of the fluid supply 400 include fluid-level indicating means and fluid-filtration means.

The fluid supply 400 is operably connected to the fluid transfer component 100. Fluid 450 may move from the fluid supply 400 to the first surface 110 via tubing, pipe or other fluid conducting means known in the art.

The apparatus 1000 comprises a means of motivating the fluid 450 from the first surface 110 to the second surface 120. In one embodiment the motivation of fluid 450 may be achieved by configuring the fluid supply 400 as a fluid reservoir 550 above the fluid transfer component 100 such that gravity will motivate the fluid 450 to move from the fluid supply 400 to the first surface 110 and subsequently to the second surface 120.

In another embodiment the apparatus 1000 may comprise a pump 500 to motivate the fluid 450 from the fluid supply 400 to the fluid transfer component 100. In this embodiment the pump may also motivate the fluid 450 from the first surface 110 to the second surface 120. In this embodiment the pump 550 may be controlled to provide a constant volume of fluid 450 at the first surface 110 with respect to the quantity of web material 200 processed. The volume of fluid 450 made available at the second surface may be varied according to the speed of the web 200. As the web speed increases the volume of available fluid 450 may be increased such that the rate of fluid transfer to the web 200 per unit length of web 200 or per unit time remains substantially constant. Alternatively the pump may be controlled to provide a constant fluid pressure at the first surface 110. This method of controlling the pump may provide for a consistent droplet size upon the second surface. The pressure provided by the pump may be varied as the speed of the web varies to provide consistently sized droplets regardless of the operating speed of the fluid transfer apparatus 1000.

In another embodiment (not shown) the fluid 450 may only partially fill the interior 140 of the fluid transfer component 100. The remainder of the interior 140 may be considered head space. A second fluid may be introduced into the head space 140 under sufficient pressure to motivate the fluid 450 from the first surface 110 to the second surface 120. In another embodiment (not shown) the head space may be occupied by an expandable bladder. The bladder may be expanded by introducing a pressurized fluid into the bladder. The expansion of the bladder may motivate the fluid 450 from the first surface 110 to the second surface 120. In each of these embodiments suitable steps must be taken such that the motivation provided by the expansion of the bladder or the introduction of a second fluid 475 results substantially only in the motivation of fluid 450 from the first surface 110 to the second surface 120 and does not motivate the fluid 450 to return to the fluid supply 400. In one embodiment the steps may comprise the installation of an appropriately oriented check valve between the fluid supply 400 and the fluid transfer component 100.

In another embodiment the fluid transfer component 100 may comprise at least one internal roller 150. The internal roller 150 forms an internal nip 155 with the first surface 110. As the fluid transfer component 100 rotates the fluid 450 may be motivated from the first surface 110 to the second surface 120 by the pressure in the nip 155. In one embodiment the internal roller 150 may be driven to rotate about a fixed axis maintaining a uniform nip pressure. The internal roller 150 may be rotated at a surface speed equivalent to or differing from that of the first surface 110. The internal roller 150 and the first surface 110 may rotate in the same direction or in opposing directions.

Figure 4:
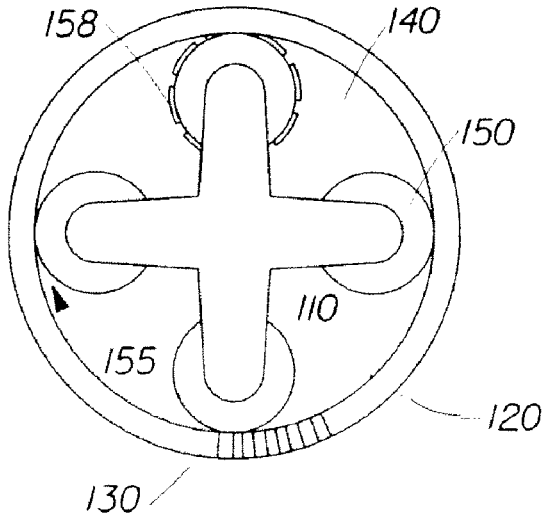

As shown in FIG. 4 the internal roller 150 may comprise a patterned surface 158. The patterned surface 158 may comprise surfaces having different elevations. Portions of the patterned surface 158 may be inset or recessed from the remainder of the surface of the internal roller 150. The patterned surface 158 may be configured in consideration of the pattern of the pores 130 such that the patterned surface 158 of the internal roller 150 will interact with the pattern of the pores 130. This interaction between the recessed portions of the patterned surface 158 and the first surface 110 may achieve less nip pressure than the interaction of the other portions of the patterned surface 158.

The interaction of the patterned surface 158 and the first surface 110 may provide the ability to achieve distinctly different fluid transfer rates at selected pores 130 depending upon the localized interaction of the first surface 110 and the patterned surface 158. Recessed portions of the patterned surface 158 may form a more open nip with the first surface 110 and may achieve less fluid motivating pressure than the closed nip provided by the remainder of the patterned surface. The patterned surface 158 may comprise portions at multiple elevations to provide multiple nip pressures.

In one embodiment the apparatus 1000 comprises a plurality of internal rollers 150. In this embodiment the plurality of internal rollers 150 provide a plurality of nips and each nip provides a point of motivation for fluid 450 from the first surface 110 to the second surface 120. The plurality of internal rollers 150 may be fixed relative to the axis to of the fluid transfer component 100 and may each be rotated as described above relative to the first surface 110. The plurality of internal rollers 150 may be mounted to a rotatable assembly to enable the plurality of internal rollers 150 to rotate about the axis of the fluid transfer component 100 and to concurrently rotate about the individual internal roller 150 axes. The rate of fluid 450 transfer may be adjusted by altering the speed of the internal rollers 150 relative to the first surface 110, by adding or removing internal rollers 150 and by adjusting the surface pattern 158 of one or more internal roller(s) 150 as set forth above.

The interaction of one or more internal rollers 150 may be adjusted to provide a constant rate of fluid 450 transfer to the web 200. The interaction may be varied with the speed of the fluid application process to continuously provide a constant amount of fluid 450 transfer to the web 200 on a per unit length of web or per unit span of time basis.

In yet another embodiment (not shown) the apparatus 1000 may comprise a piston or other means adapted to apply pressure to the fluid 450 in the fluid supply 400 or the fluid 450 present in the fluid transfer component 100. The application of this pressure to the fluid 450 motivates the fluid 450 from the first surface 110 to the second surface 120.

In any embodiment, a feedback system may be provided that determines the rate of fluid application to the web on a per unit length of web or unit mass of web or unit span of time basis. This feedback may be used to adjust the rate of fluid application such that a predetermined desired amount of fluid application occurs. As an example, the web 200 may be optically scanned after fluid 450 transfer. The optical scanner may be programmed to determine the area of the applied fluid 450 and an inference may be drawn from this area relative to the amount of applied fluid 450. Fluid motivation may be adjusted to provide more or less fluid 450 as desired. In another embodiment, a mass determining instrument such as a Honeywell Measurex instrument adapted to detect mass flow may be used to determine the amount of fluid mass picked up per unit mass of web 200. This value may be used to provide an input to the controller of the fluid motivator to adjust the amount of applied fluid to achieve a desired rate of fluid application.

The apparatus 1000 may further comprise a doctor blade as is known in the art. The doctor blade may be configured such that all but a thin film of fluid 450 is removed from the surface of the fluid transfer component as the second surface 120 moves past the doctor blade. The doctor blade may alternatively be configured to remove all fluid 450 and any accumulated debris from the second surface 120. The position of the doctor blade relative to the second surface may be configured to be adjusted at the discretion of the operator of the apparatus. Alternatively the position of the doctor blade may be fixed relative to the second surface 120.

The apparatus 1000 may further comprise a brush configured to wipe the second surface substantially clean of fluid 450 and any accumulated debris. The brush may comprise bristles adapted to clean the second surface 120 without damaging the second surface 120.

The fluid 450 may comprise any fluid that may be applied to the fluid receiving component 200. Exemplary fluids 450 include, without being limiting, inks, strengthening agents, softening agents, surfactants, adhesives, lubricants, waterproofing agents, release agents, surface conditioning agents, cleaning agents, solvents, scents and lotions. The application of fluid 450 is not substantially limited by the fluid viscosity. Very low viscosity fluid may be satisfactorily applied by providing small diameter pores 130 and by applying low motivating pressures.

A low viscosity ink may be accurately applied using pores 130 having a diameter of about 0.002 inches (0.051 mm) and a pressure of about 1-2 psi (about 7-14 kPa). The application of very high viscosity fluids 450 is limited only by the ability to motivate the fluid 450 from the fluid supply 400 to contact with the first surface 10. The viscosity of the fluid 450 may be adjusted by the addition of thickeners or by thinning the fluid with an appropriate solvent. The viscosity may also be adjusted by heating or cooling the fluid 450.

In one embodiment the temperature of fluid 450 may be adjusted by appropriate heating and/or cooling equipment added to the fluid supply 400 as is known in the art. In another embodiment the fluid temperature may be adjusted by heating or cooling the fluid transfer component 100. In this embodiment the fluid transfer component may comprise electrical resistance heating elements, electromagnetic refrigeration units, or a system of fluid conducting channels whereby a heating and/or cooling fluid may be circulated to adjust the temperature of the fluid transfer component 100 and subsequently the fluid 450.

EXAMPLE 1

In a paper-converting process, a steel cylinder having a shell thickness of about 0.125 inches (about 3 mm) and a width of about 6 inches (about 15 cm) is rotatably supported along an axis. A rotary union connects the interior of the shell to a fluid supply pump. The shell comprises an array of pores 130 arranged in a uniform pattern about the outer surface of the shell. The pores each have a diameter of about 0.002 inches (0.15 mm). A paper softening agent is pumped into the interior of the shell through the rotary union. The pump provides sufficient fluid pressure to motivate the agent through the pores forming droplets upon the outer surface of the shell.

A paper web is routed through the converting apparatus and into contact with the fluid droplets upon the outer surface of the shell. The fluid droplets transfer from the outer surface to the web material providing an array of deposits of the agent upon the web corresponding to the array of pores. The spacing and arrangement of the pores is selected to provide a desired tactile sensation for the paper consumer associated with the presence of the agent. The tactile sensation may be achieved without the need to provide a continuous coating of the agent.

EXAMPLE 2

In a paper converting process a log of a paper web is wound from a continuous web supply. The log is wound about a cardboard core. As a desired web quantity for each log is achieved the web of the log is separated from the continuous supply of the web.

The trailing edge of the log is not attached to the log at this point and is considered a web tail. The log proceeds through the converting apparatus to a log tail sealer.

The tail sealer is adapted to attach the web tail to the remainder of the log. The tail sealer comprises a flat plate over which the log is constrained to roll. The plate comprises an array of pores extending across the plate and transverse to the direction of travel of the log. The pores are connected to a cylindrical fluid reservoir disposed beneath the flat plate. The fluid reservoir is operably connected to a fluid supply. An internal roller rotates in contact with the internal surface of the reservoir. The rotation of the internal roller is sequenced such that an array of adhesive droplets is formed upon the flat plate prior to the passage of each log. As each log proceeds across the flat plate the adhesive droplets transfer from the flat plate to a portion of the log. As the log continues to roll the heretofore unsealed web tail contacts the portion of the log that the adhesive has transferred to. The log may subsequently be subjected to a nip pressure to increase the contact between the web tail and the adhesive droplets.

The timing of the motion of the internal roller may be adjusted as the speed of the tail sealer is increased. This increase in speed may provide for a fresh set of adhesive droplets being formed upon the flat plate prior to the passage of each new roll.

The flat plate may comprise a low energy surface such as Dragon Elite 4 coating from Plasma Coatings of TN, Inc. of Arlington, Tenn. to aid in maintaining the sanitation of the equipment. This coating aids in sanitation by reducing the likelihood that any web fibers or residual adhesive will remain upon the flat plate.

EXAMPLE 3

In a web printing operation a series of five print cylinders are arrayed at respective points around the circumference of a web support cylinder. Each of the print cylinders comprises a thin shell and an array of pores specifically situated to provide an array of dots of ink that may subsequently be transferred to a web material passing between the print cylinder and the support cylinder. The pore array of each cylinder may be distinct from the array of the other print cylinders. The particular pore array of each cylinder may be related to the particular ink color to be applied by each cylinder. The combination of the five pore arrays in the proper spatial relationship may yield a multi-color composite image. The pores may also be of varying size in order to incorporate Amplitude Modulation screening or other aesthetic effects.

A series of five inks may be successively applied to a white web material as the web material passes between the print cylinders and the support cylinder. Each print cylinder applies a single color of ink. The respective rotary position of each of the print and support cylinders are determined by respective rotary encoders coupled to the cylinders. These rotary positions are provided to a controller that continuously monitors the relative rotary positions of the print and support cylinders and adjusts the relative cylinder positions as needed to maintain pint registration among the five inks and the web material. The adjustment of the respective positions is accomplished by the use of a series of servo motors. One servo motor is coupled to each print cylinder and to the support cylinder. The servo motors are connected to a communications network and the relative rotary positions of the servo motor cylinder combinations may be adjusted at the direction of the controller. The end result is the successive application of five arrays of ink dots in registration with each other resulting in a composite color image upon the web material.

The dimensions and values disclosed herein are not to be understood as being strictly limited to the exact dimensions and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for transferring fluid, the method comprising steps of:

a) providing a fluid transfer component comprising a first surface, a second surface, a non-random pattern of distinct pores, the pores connecting the first surface and the second surface, the pores disposed at preselected locations, said fluid transfer component having a permeable nature and an inherent porosity;

b) providing a fluid receiving component comprising a fluid receiving surface;

c) decoupling said permeable nature of said fluid transfer component from said inherent porosity of said fluid transfer component;

d) motivating a fluid into contact with the first surface and subsequently through the distinct pores to the second surface;

e) bringing the second surface and the fluid receiving surface into fluid transfer proximity; and, f) transferring fluid from the second surface to the fluid receiving surface.

2. The method according to claim 1 wherein the step of providing a fluid transfer component further comprises the step of providing a rotatable cylindrical shell.

3. The method according to claim 1 further comprising the step of moving the fluid receiving surface into fluid transfer proximity with the second surface.

4. The method according to claim 1 further comprising the step of moving the second surface into fluid transfer proximity with the fluid receiving surface.

5. The method according to claim 1 wherein the step of providing a fluid receiving component further comprises the step of providing an absorbent web material.

6. The method according to claim 1 further comprising the step of applying the fluid to the fluid receiving surface in registration with a localized feature of the fluid receiving component.

7. The method according to claim 1 further comprising the step of contactingly engaging the second surface and the fluid receiving surface.

8. The method according to claim 1 further comprising the step of varying the motivation of the fluid according to the amount of fluid transferred.

9. The method according to claim 1 further comprising the step of varying the motivation of the fluid according to a speed of the fluid receiving surface.

* * * * *

UNITED STATES PATENT AND TRADEMARK OFFICE

CERTIFICATE OF CORRECTION

PATENT NO. : 7,976,905 B2
APPLICATION NO. : 12/552561
DATED : July 12, 2011
INVENTOR(S) : McNeil et al.

It is certified that error appears in the above-identified patent and that said Letters Patent is hereby corrected as shown below:

In the Specifications:

Column 5
Line 15: Delete "to".

Column 8
Line 44: Delete second occurrence of "to"

Column 9
Line 48: Delete "10" and insert --110`--.

Signed and Sealed this
Sixth Day of March, 2012

David J. Kappos

David J. Kappos
*Director of the United States Patent and Trademark Office*